US009211759B2

(12) United States Patent
Cohen

(10) Patent No.: US 9,211,759 B2
(45) Date of Patent: Dec. 15, 2015

(54) WRITING INSTRUMENT HOLDER

(71) Applicant: Brian D Cohen, San Pedro, CA (US)

(72) Inventor: Brian D Cohen, San Pedro, CA (US)

( * ) Notice: Subject to any disclaimer, the term of this patent is extended or adjusted under 35 U.S.C. 154(b) by 521 days.

(21) Appl. No.: 13/653,188

(22) Filed: Oct. 16, 2012

(65) Prior Publication Data

US 2013/0101338 A1 Apr. 25, 2013

Related U.S. Application Data

(60) Provisional application No. 61/550,386, filed on Oct. 22, 2011.

(51) Int. Cl.
*B43M 99/00* (2010.01)
*B43K 23/00* (2006.01)

(52) U.S. Cl.
CPC ..... *B43M 99/006* (2013.01); *B43K 23/002* (2013.01); *B43K 23/00* (2013.01)

(58) Field of Classification Search
CPC combination set(s) only.
See application file for complete search history.

(56) References Cited

U.S. PATENT DOCUMENTS

| | | | | | |
|---|---|---|---|---|---|
| 2,412,938 | A | * | 12/1946 | Amoth | 211/69.5 |
| 2,792,934 | A | * | 5/1957 | Rocchetti | 206/379 |
| 3,159,372 | A | * | 12/1964 | McIntosh | 248/683 |
| 3,367,483 | A | * | 2/1968 | Studen | 206/379 |
| 3,696,920 | A | * | 10/1972 | Lahay | 206/370 |
| 3,915,213 | A | * | 10/1975 | Graham, Jr. | 206/553 |
| 5,188,242 | A | * | 2/1993 | Smith | 211/69 |

* cited by examiner

*Primary Examiner* — David Walczak
(74) *Attorney, Agent, or Firm* — Michael Ries

(57) ABSTRACT

A writing instrument holder that includes an adhesive base that includes a generally shape, a plurality of holding notches and a holding slot and an adhesive backer insert with a vertical planar base and a perpendicular planar insert. The writing instrument holder also includes a peel away cover with a front facing, a back facing and a generally square planar shape, the peel away cover is placed over the front facing of the vertical planar base to protect an adhesive.

16 Claims, 4 Drawing Sheets

WRITING INSTRUMENT HOLDER

This application claims priority to U.S. Provisional Application 61/550,386 filed on Oct. 22, 2011, the entire disclosure of which is incorporated by reference.

TECHNICAL FIELD & BACKGROUND

Pens and pencils are so relatively thin, they can hide or become lost just about anywhere, especially on top of a desk. With most office desktops full of paperwork, folders, binders and other supplies and accessories, it can be challenging to keep track of where pens and other writing instruments are on the desktop.

The present invention is a holder. More specifically, the present invention is a writing instrument holder.

It is an object of the invention to provide a writing instrument holder that utilizes an adhesive surface to relatively easily remove the writing instrument holder on a desired surface.

It is an object of the invention to provide a writing instrument holder that keeps one or more pens, pencils and other writing instruments within relatively easy reach in one centralized spot and helps prevent the one or more pens, pencils and other writing instruments from getting lost, reducing the frequency with which they need to be replaced.

It is an object of the invention to provide a writing instrument holder that can be easily removed as needed, without damaging any surface that utilizes scratch-resistant adhesive material that won't leave any residue.

What is really needed is a writing instrument holder that utilizes an adhesive surface to relatively easily remove the writing instrument holder on a desired surface that keeps one or more pens, pencils and other writing instruments within relatively easy reach in one centralized spot and helps prevent the one or more pens, pencils and other writing instruments from getting lost, reducing the frequency with which they need to be replaced that can be easily removed as needed, without damaging any surface that utilizes scratch-resistant adhesive material that won't leave any residue.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention, however, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1A:
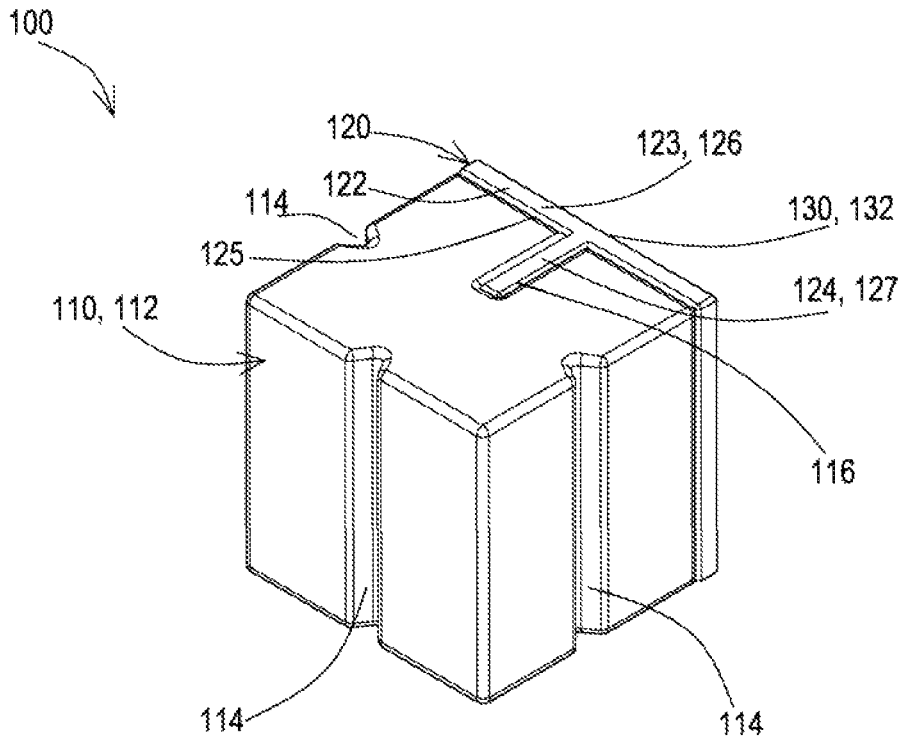
FIG. 1A illustrates a side perspective view of a writing instrument holder, in accordance with one embodiment of the present invention.

FIG. 1A illustrates a side perspective view of a writing instrument holder 100, in accordance with one embodiment of the present invention.

The writing instrument holder 100 includes an adhesive putty base 110, an adhesive backer insert 120 and a peel away cover 130. The adhesive putty base 110 has a generally cubical shape 112, a plurality of holding notches 114 and a holding slot 116. The adhesive putty base 110 is made of putty but can be made of silicone or any other suitable material. Additional details regarding the adhesive putty base 110 are illustrated and described in FIG. 1B and its description. The adhesive backer insert 120 has a vertical planar base 122 and a perpendicular planar insert 124. The vertical planar base 122 has a front facing 123 and the back facing 125 with an adhesive 126 disposed on the entire front facing 123. The perpendicular planar insert 124 is perpendicularly attached to a center portion 127 of the back facing 125 of the vertical planar base 122. The perpendicular planar insert 124 is removably inserted into the holding slot 116 of the adhesive putty base 110. Additional details regarding the adhesive backer insert 120 are illustrated and described in FIG. 1C and its description. The peel away cover 130 has a generally square planar shape 132 that is placed over the front facing 123 of the vertical planar base 122 to protect the adhesive 126 disposed over the entire front facing 123. Additional details regarding the peel away cover 130 are illustrated and described in FIG. 1C and its description.

Figure 1B:
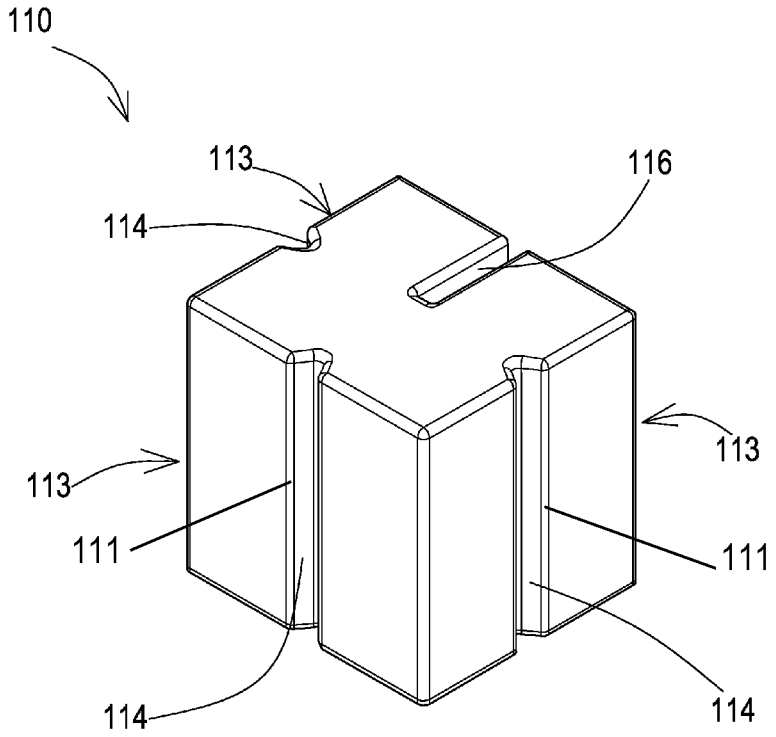
FIG. 1B illustrates a side perspective view of an adhesive putty base of a writing instrument holder, in accordance with one embodiment of the present invention.

FIG. 1B illustrates a side perspective view of an adhesive putty base 110 of a writing instrument holder 100, in accordance with one embodiment of the present invention. The writing instrument holder 100 and the adhesive putty base 110 illustrated and described in FIG. 1B is similar to the writing instrument holder 100 and the adhesive putty base 110 illustrated and described in FIG. 1A. The adhesive putty base 110 has holding notches 114 where one holding notch 114 is disposed on a middle portion 111 of each of three sides 113 of the adhesive putty base 110. The holding notches 114 can releasably secure up to three pens, three pencils or three writing instruments or three objects similar to a writing instrument. The holding slot 116 also receives and releasably secures the perpendicular planar insert 124 of the adhesive backer insert 120.

Figure 1C:
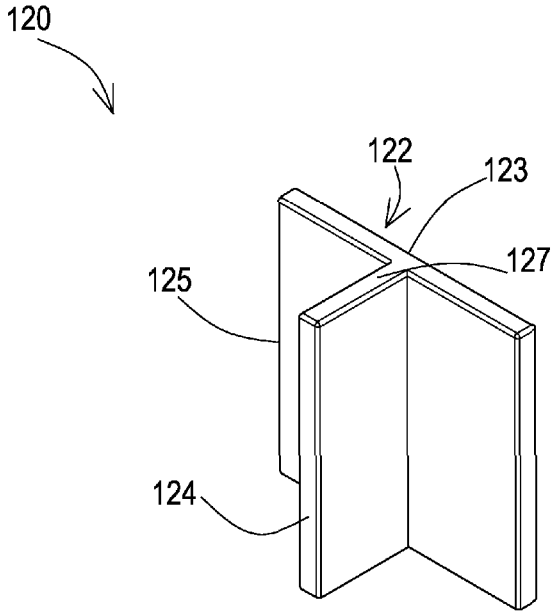
FIG. 1C illustrates a side perspective view of an adhesive backer insert of a writing instrument holder, in accordance with one embodiment of the present invention.

FIG. 1C illustrates a side perspective view of an adhesive backer insert 120 of a writing instrument holder 100, in accordance with one embodiment of the present invention. The adhesive backer insert 120 illustrated and described in FIG. 1C is similar to the adhesive backer insert 120 illustrated and described in FIG. 1A. The adhesive backer insert 120 is made of STYROFOAM™ or polyurethane material or other suitable rigid material to provide rigidity to the writing instrument holder 100.

Figure 1D:
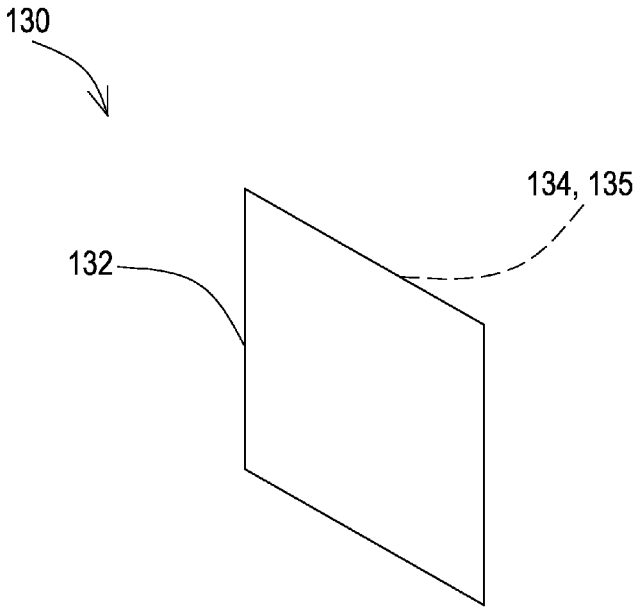
FIG. 1D illustrates a side view of a peel away sticker of a writing instrument holder, in accordance with one embodiment of the present invention.

FIG. 1D illustrates a side view of a peel away cover 130 of a writing instrument holder 100, in accordance with one embodiment of the present invention. The peel away cover 130 illustrated and described in FIG. 1D is similar to the peel away cover 130 illustrated and described in FIG. 1A. The peel away cover 130 has a front facing 132 and a back facing 134 where the front facing 132 protects the front facing 123 of the vertical planar base 122 and is peeled off to expose the adhesive 126 disposed over the entire front facing 123 to be removably applied to a desired surface or object. The back facing 134 of the peel away cover 130 is in contact with the adhesive 126 disposed over the entire front facing 123 and removably adheres to the adhesive 126 disposed over the entire front facing 123. The back facing 134 of the peel away cover 130 is in contact with the adhesive 126 disposed over the entire front facing 123 is covered with a non-adhering material 135 that releasably adhere to the adhesive 126 disposed over the entire front facing 123.

The writing instrument holder removably adheres to a computer, a desk, a refrigerator or other suitable object or surface to prevent one or more pens, pencils and other writing instruments from getting lost. The writing instrument holder utilizes scratch-resistant adhesive material that won't leave any residue or scratches when applied or removed from a desired surface. The writing instrument holder is made partially of integrated STYROFOAM™ or polyurethane material that gives the writing instrument holder its relatively sturdy shape. The writing instrument holder is also made partially of a relatively durable putty-like material that releasably holds one or more writing instruments, yet allows the writing instruments to be removed, without pulling the writing instrument holder off its attached surface. The writing instrument holder can also be made of silicone or another similar or suitable material, instead of putty.

The writing instrument holder includes a plurality of holding grooves to releasably secure one or more writing instruments. The writing instrument holder can be designed to hold up to 3 writing instruments or other objects with a similar writing instrument size and shape. The writing instrument holder can be utilized at home, at an office, at a school classroom or any suitable location where pens and other writing instruments are used. The writing instrument holder allows one or more writing instruments to stay relatively nearby and within reach in one convenient location. The writing instrument holder features a peel-away adhesive backing that releasably attaches to a surface. The integrated STYROFOAM™ or polyurethane material contributes to its relatively sturdy shape while relatively soft, but strong putty material keeps the one or more writing instruments releasably held in place. The writing instrument holder also remains in place when a writing instrument is being removed from the writing instrument holder.

The writing instrument holder fits relatively easily in an office environment. To set-up the writing instrument holder peel away the adhesive strip on the back of the writing instrument holder and securely attach the holder to the side of a desired object or surface such as a computer or other suitable object or surface. The writing instrument holder can accommodate up to 3 pens, pencils or other suitable writing instruments. A user can insert their writing instrument on the exposed putty surface where the writing instrument will remain. When a writing instrument is needed, the writing instrument can be relatively quickly and easily located and grabbed from the writing instrument holder.

The writing instrument holder keeps pens, pencils and other suitable writing instruments close by and within reach in one convenient and centralized spot. The writing instrument holder helps prevent writing instruments from rolling away, getting lost, or covered-up under paperwork or clutter. The writing instrument holder helps save money, reduces the frequency that boxes of writing instruments need to be purchased, helps save time, creates a relatively more efficient workspace or environment and encourages users to return writing instruments to the same place, so writing instruments can be relatively quickly and easily found when needed. The writing instrument holder is relatively sleek and compact with an unobtrusive design that won't clash aesthetically with décor.

While the present invention has been related in terms of the foregoing embodiments, those skilled in the art will recognize that the invention is not limited to the embodiments described. The present invention can be practiced with modification and alteration within the spirit and scope of the appended claims. Thus, the description is to be regarded as illustrative instead of restrictive on the present invention.

The invention claimed is:

1. A writing instrument holder, comprising:

an adhesive base, a plurality of holding notches and a holding slot, wherein the adhesive base has one of the holding notches disposed on a middle portion of each of three sides of the adhesive base;

an adhesive backer insert with a vertical planar base and a perpendicular planar insert, the vertical planar base having a front facing and a back facing, with an adhesive disposed on the front facing of the vertical planar base; and a peel away cover with a front facing, a back facing and a generally square planar shape, the peel away cover is placed over the front facing of the vertical planar base to protect the adhesive disposed over the front facing of the vertical planar base.

2. The writing instrument holder according to claim 1, wherein the holding notches releasably secure up to a selected one of three pens, three pencils and three writing instruments.

3. The writing instrument holder according to claim 1, wherein the holding notches releasably secure up to a selected one of three objects similar to a writing instrument.

4. The writing instrument holder according to claim 1, wherein the holding slot receives and releasably secures the perpendicular planar insert of the adhesive backer insert.

5. The writing instrument holder according to claim 1, wherein the front facing of the peel away cover protects the front facing of the vertical planar base, the peel away cover is peeled off to expose the adhesive disposed over the front facing of the vertical planar base, the vertical planar base to be removably applied to a selected one of a desired surface and a desired object.

6. The writing instrument holder according to claim 1, wherein the back facing of the peel away cover is in contact with the adhesive disposed over the front facing, the peel away cover removably adheres to the adhesive disposed over the front facing.

7. The writing instrument holder according to claim 1, wherein the perpendicular planar insert is perpendicularly attached to a center portion of the back facing of the vertical planar base.

8. The writing instrument holder according to claim 1, wherein the perpendicular planar insert is removably inserted into the holding slot of the adhesive base.

9. The writing instrument holder according to claim 1, wherein the back facing of the peel away cover is in contact with the adhesive disposed over the front facing and is covered with a non-adhering material that releasably adheres to the adhesive disposed over the front facing of the vertical planar base.

10. A writing instrument holder, comprising:

an adhesive base, a plurality of holding notches and a holding slot, the adhesive base has one of the holding notches disposed on a middle portion of each of three sides of the adhesive base, wherein the adhesive base is made of silicone;

an adhesive backer insert with a vertical planar base and a perpendicular planar insert, the vertical planar base has a front facing and a back facing with an adhesive disposed on the front facing of the vertical planar base, the holding slot receives and releasably secures the perpendicular planar insert of the adhesive backer insert; and a peel away cover with a front facing, a back facing and a generally square planar shape, the peel away cover is placed over the front facing of the vertical planar base to protect the adhesive disposed over the front facing of the vertical planar base, the front facing of the peel away cover protects the front facing of the vertical planar base, the peel away cover is peeled off to expose the adhesive disposed over the front facing of the vertical planar base, the vertical planar base to be removably applied to a selected one of a desired surface and a desired object, the back facing of the peel away cover is in contact with the adhesive disposed over the front facing.

11. The writing instrument holder according to claim 10, wherein the holding notches releasably secure up to a selected one of three pens, three pencils and three writing instruments.

12. The writing instrument holder according to claim 10, wherein the holding notches releasably secure up to a selected one of three objects similar to a writing instrument.

13. The writing instrument holder according to claim 10, wherein the perpendicular planar insert is perpendicularly attached to a center portion of the back facing of the vertical planar base.

14. The writing instrument holder according to claim 10, wherein the perpendicular planar insert is removably inserted into the holding slot of the adhesive base.

15. The writing instrument holder according to claim 10, wherein the adhesive backer insert is made of rigid material to provide rigidity to the writing instrument holder.

16. The writing instrument holder according to claim 10, wherein the back facing of the peel away cover is covered with a non-adhering material that releasably adhere to the adhesive disposed over the front facing of the vertical planar base.

* * * * *